United States Patent [19]

Luetzelschwab

[11] Patent Number: 4,782,847

[45] Date of Patent: Nov. 8, 1988

[54] FLOW CONTROL APPARATUS AND METHOD

[75] Inventor: Wayne E. Luetzelschwab, Littleton, Colo.

[73] Assignee: Marathon Oil Company, Findlay, Ohio

[21] Appl. No.: 638,056

[22] Filed: Aug. 6, 1984

Related U.S. Application Data

[63] Continuation of Ser. No. 391,240, Jun. 23, 1982, abandoned.

[51] Int. Cl.[4] ..... F17D 1/16

[52] U.S. Cl. ..... 137/13; 138/44

[58] Field of Search ..... 137/13, 1, 14; 138/44

[56] References Cited

U.S. PATENT DOCUMENTS

| | | | |
|---|---|---|---|
| 1,201,964 | 10/1916 | Howard | 138/44 X |
| 2,330,564 | 9/1943 | Dyer | 138/44 X |
| 2,629,403 | 2/1953 | Allen | 138/44 X |
| 3,371,714 | 3/1968 | Katzer | 166/42 |
| 4,105,049 | 8/1978 | Anderson | 138/44 |

*Primary Examiner*—Alan Cohan

*Attorney, Agent, or Firm*—Jack L. Hummel; Rodney F. Brown

[57] ABSTRACT

Apparatus, and method, for controlling the flow of dilute solutions of polymers such as dilute aqueous solutions of partially hydrolyzed polyacrylamides without causing any significant degradation of the polymer comprising the solutions. In one embodiment, the apparatus comprises a plurality of fixed restrictions connected in series with nipples having a larger internal diameter than the fixed restrictions. In another embodiment, the apparatus comprises at least one fixed restriction in communication with a flow control valve such as a needle valve.

5 Claims, 1 Drawing Sheet

FLOW CONTROL APPARATUS AND METHOD

This application is a continuation of application Ser. No. 391,240, filed June 23, 1982, now abandoned.

TECHNICAL FIELD

The present invention relates to apparatus, and to a method, for controlling the flow of dilute polymer solutions in a conduit to prevent degradation of the polymer comprising the solutions.

BACKGROUND OF PRIOR ART

Polymers such as partially hydrolyzed polyacrylamides are known to degrade to a substantial extent, even at low concentrations, when subjected to turbulences normally present in the equipment utilized to convey such polymers from one location to another. This problem is especially acute in situations where, as in the use of such polymer solutions in the recovery of oil from subterranean oil-bearing formations, the polymer solutions are transported through a series of conduits and flow control valves prior to injection into a wellbore. Degradation of the polymer adversely affects the injectivity and mobility properties of the polymer thereby greatly diminishing its ability to satisfy the performance demands of the oil-bearing formation. When very large pressure drops of the order of 500 psig, or more, are required in such operations, it is common practice to use a long length of small diameter tubing, or sand packs, to reduce polymer degradation. In order to vary the pressure drop by this means, it is necessary to shorten, or lengthen, the small diameter tubing, or vary the number of sand packs. This practice is cumbersome, at best, and does not provide the degree of control necessary to attain a uniform and reliable result.

BRIEF SUMMARY OF THE INVENTION

Aqueous solutions of polyacrylamides, especially partially hydrolyzed acrylamides, have been widely used as drive fluids and/or mobility buffers in the secondary or tertiary recovery of oil from subterranean formations or reservoirs. The aqueous solutions are prepared by polymerizing an acrylamide monomer and then reacting the polymer with a monovalent base such as dilute sodium hydroxide to hydrolyze a predetermined mole percent of the amide groups comprising the polymer. The concentration of the partially hydrolyzed polymer in the aqueous solutions is of the order of 6%, and the solution has a gel-like consistency. The 6% solution desirably is first diluted with water to form a 1%, by weight, solution of the polymer, and then, prior to injection into an input well, is further diluted with water to provide an aqueous solution comprising anywhere from 50 to 5000 parts, more or less, per million of the polymer.

The apparatus, and method, of the present invention enable the transport of dilute solutions of polymers such as partially hydrolyzed polyacrylaamides with substantially no degradation of the polymer taking place. As a result, the injectivity and mobility properties of the polymer solution remain essentially constant thereby imparting a high degree of predictability to the performance capabilities of the solution. This enables smaller volumes of the polymer solutions to be used, and contributes significantly to the efficiency of the oil recovery operation, factors which materially lower the normally high costs of such operations.

The apparatus of the present invention, in brief, comprises conduit means for transporting a polymer solution from one location to another, and flow restriction means positioned in the conduit means. In one form of the invention; the flow restriction means advantageously includes at least one relatively short length of small diameter pipe or tubing positioned between nipples or headers having a diameter or cross-sectional area substantially larger than the diameter or cross-sectional area of the short length of pipe or tubing. In a preferred embodiment, two, or more, short lengths of pipe or tubing are alternately positioned, in series, between headers located in the conduit means. In still another form of the apparatus, a flow control valve, desirably a flow control valve having a tapered flow control element, as exemplified by a needle valve, is positioned downstream of the flow restriction means. It has been discovered that when the flow restriction means of the present invention is used in a conduit for transporting an aqueous polymer solution, specifically, an aqueous solution of a partially hydrolyzed polyacrylamide, essentially no degradation of the polymer due to shear forces occurs even while the solution is experiencing an appreciable drop in fluid pressure as it contracts and expands.

The apparatus of the present invention has special utility in oil field operations where it is desired to attain a drop in fluid pressure of a magnitude such that it cannot be achieved with a flow control valve alone without appreciable polymer degradation. In the case of dilute aqueous solutions of partially hydrolyzed polyacrylamides, it usually is desirably to effect a pressure drop in the solutions at a point prior to injection of the solutions into an input well. To this end, the apparatus advantageously is positioned in the polymer solution conduit means located between the final polymer dilution station and the input well site. Standard piping or tubing can be utilized in assembling the apparatus of the present invention. The apparatus, moreover, can be used in conjunction with conduits conventionally used in field operations, and no special tools or equipment are necessary to install the apparatus.

The foregoing, and other features and advantages of the invention will become more apparent from the description to follow,taken in conjunction with the accompanying drawings.

DETAILED DESCRIPTION OF THE INVENTION

The equipment utilized in the on-site preparation of a dilute aqueous polymer solution of the type employed in the secondary or tertiary recovery of oil from an oil-bearing subterranean formation typically includes a polymerization reactor or vessel, and a hydrolyzer. Auxiliary equipment generally comprises a water and monomer source, a catalyst source, pumps, mixers, and means for diluting the polymer solution prior to injection into an input well of the formation. Where the aqueous polymer solution comprises a partially hydrolyzed polyacrylamide, the concentration of the polymer in the final solution usually will be in the range of from about 50 to 5000 parts per million, especially desirably from about 500 to about 2000 parts per million. In the field, such aqueous polymer solutions may be introduced into an input well at rates of from about 1 to about 100, usually from about 30 or 50 to about 60 gallons per minute. The total volume of the dilute solution injected in a 24 hour period can range from about 100 to about 2000 barrels, more or less.

As indicated above, the use of the fixed flow restriction means of the present invention in a conduit for transporting dilute aqueous solutions of a polymer, such as a partially hydrolyzed polyacrylamide, provides a polymer at the injection site which has undergone essentially no degradation. What is equally surprising and unexpected, this result is achieved at pressure drops across the flow restriction means of 500 psig, or more, under the turbulence normally encountered by fluids as they pass through conduits which differ substantially in cross-sectional area.

Figure 1:
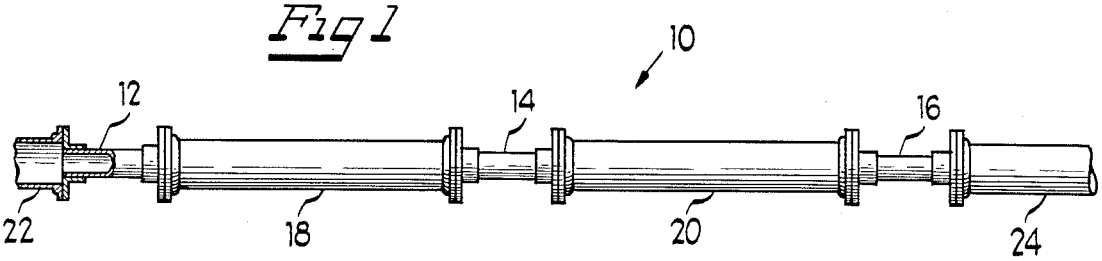
FIG. 1 is a side view in elevation of an embodiment of the flow control apparatus of the present invention.

The embodiment of the apparatus illustrated in FIG. 1, and designated generally by reference numeral 10, comprises a plurality of fixed restrictions 12, 14 and 16 connected in series with nipples 18 and 20. The inlet end of the restriction 12 and the outlet end of the restriction 16 are shown connected to conduits or headers 22 and 24, respectively. It should be understood that the number of fixed restrictions utilized in accordance with the practice of the present invention is variable. Generally speaking, the number of fixed restrictions will be dependent upon the total pressure drop desired and the maximum pressure drop permissible to enable the fixed restrictions to minimize degradation.

The restrictions 12, 14 and 16 advantageously comprise short lengths of metal piping or tubing, preferably fabricated of stainless steel. The length of the restrictions can range from about a half inch, to 2 or 3 inches. The internal diameter of the restrictions may vary from about 0.063 inch to about 0.50 inch, more or less. The nipples 18 and 20 also advantageously are made of stainless steel, and desirably have a length of the order of from about 2 to about 6 or 8 inches, and an internal diameter ranging from about 0.5 inch to about 3 inches. The ends of the restrictions are externally threaded, and are coupled to the nipples 18 and 20, and the conduits 22 and 24, by suitable fittings or connectors.

Figure 2:
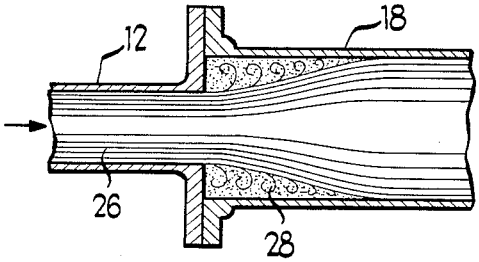
FIG. 2 is a sectional view which schematically illustrates the flow pattern of a polymer solution as it passes from a small diameter pipe or tube into a larger diameter conduit.
Figure 3:
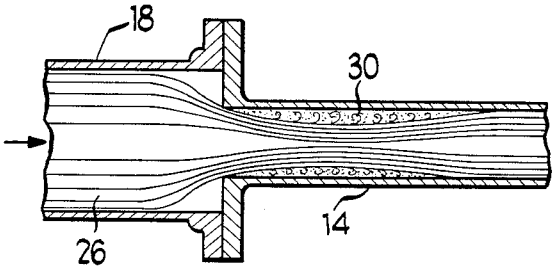
FIG. 3 is a sectional view which schematically illustrates the flow pattern of a polymer solution as it passes from a large diameter conduit into a small diameter pipe or tube.

The flow pattern of the polymer solution in the embodiment of the apparatus shown in FIG. 1 is schematically illustrated in FIGS. 2 and 3. As the fluid stream 26 passes from the fixed restriction 12, for example, as seen in FIG. 2, into the larger diameter nipple 18, the fluid expands to fill the entire cross-sectional area of the nipple. The usual vortices 28 which characterize such an expansion exist in the space at the inlet end of the nipple contiguous to the outlet end of the restriction. This turbulence, however, is not of a magnitude to cause any measurable shear degradation of the polymer. In FIG. 3, the fluid stream 26 is shown exiting from the nipple 18 into the restriction 14. As the fluid stream reaches the inlet end of the smaller diameter restriction 14, the stream breaks contact with the wall of nipple 18 at the outlet end thereof. A jet is formed at the inlet end of the restriction 14 which first contracts and then expands to fill the entire cross-sectional area of the restriction 14. Vortices 30 are formed in the restriction 14 at the point where the fluid jet first contracts. As in the case of the vortices 28 formed at the inlet end of the nipple 18, the vortices 30 do not cause any measurable shear degradation of the polymer. The process of contraction and expansion of the fluid stream is repeated as it traverses the apparatus 10.

By way of illustration, and in order to demonstrate the unique and surprising results attained with the apparatus of the present invention, an aqueous solution containing approximately 500 parts per million of a partially hydrolyzed polyacrylamide was transported through an arrangement such as the one illustrated in FIG. 1. The flow rate on the inlet side of the fixed restriction 12 was about 8.1 gallons per minute at a fluid pressure of about 308 psig. The viscosity of the solution was approximately 52.1 centipoises. The pressure drop across the apparatus, as measured at the header 24 was about 308 psig. The viscosity of the polymer solution was unchanged. The zero change in viscosity of the polymer solution indicated that no degradation of the polymer occurred despite the substantial pressure drop, and the repeated contraction and expansion of the polymer solution.

Figure 4:
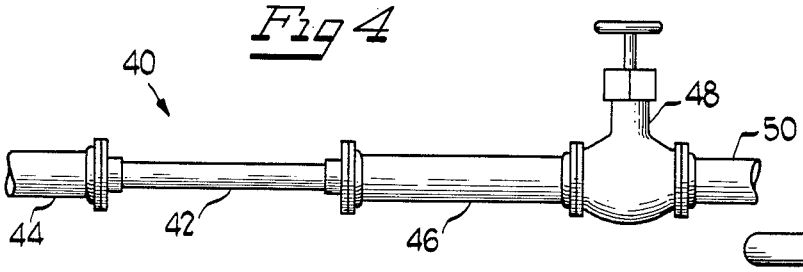
FIG. 4 is a side view in elevation of another embodiment of the apparatus of the present invention showing a control valve of the needle valve type used in conjunction with a fixed flow restriction.
Figure 5:
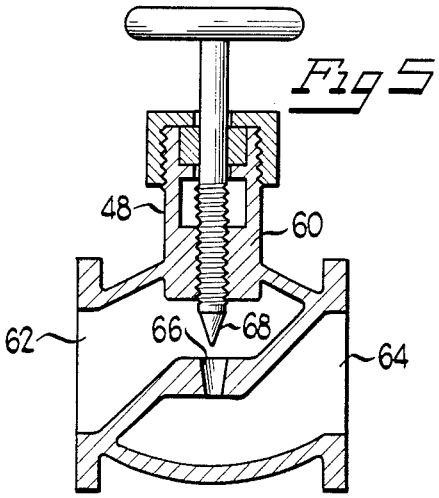
FIG. 5 is a sectional view of the flow control valve shown in FIG. 4

The embodiment of the apparatus shown in FIG. 4, and designated generally by reference numeral 40, comprises a single fixed restriction 42 connected to a pair of nipples 44 and 46. The nipple 46, in turn, is connected to a needle valve 48. The discharge side or outlet of the valve 48 is connected to a nipple or header 50. The unique ability of a flow control valve having a tapered flow control element, as exemplified by a needle valve, to enable a polymer solution to undergo an appreciable reduction in fluid pressure as it flows across the valve while at the same time substantially preventing shear degradation of the polymer is disclosed in my co-pending patent application Ser. No. 361,622, filed Mar. 25, 1982, entitled Flow Control Apparatus and Method. The apparatus 40 combines the advantages of a fixed restriction and a flow control valve of the needle type. The arrangement illustrated in FIG. 4 is especially useful where it is desired to attain pressure drops which may be too extreme for a flow control valve alone. Thus, for example, if the desired pressure drop is of the order of 500 psig, or more, and it is determined that the use of a flow control valve gives rise to polymer degradation at a pressure drop at the level of about 250 psig, the use of a fixed restriction will provide a pressure drop of approximately 300 psig thereby enabling the flow control valve to function at pressure drops at the 200 psig, and lower, levels. FIG. 5 is a somewhat schematic sectional view of the valve 48 of FIG. 4. As shown, the valve has a housing 60 having an inlet end 62 and an outlet end 64. A valve seat 66 for receiving a tapered or pointed plunger 68 is positioned in the housing. The orifice size of the valve 48 is somewhat variable. Generally speaking, however, it is preferred to use a valve having an orifice size in the range of from about 0.05 inch to about 2 inches, especially from about 1 inch to about 1.5 inches in diameter.

Figure 6:
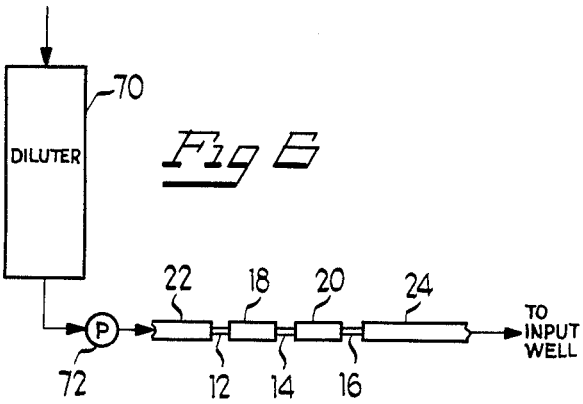
FIG. 6 is a schematic view of an embodiment of the apparatus positioned in a conduit located between a portion of the equipment employed for preparing a dilute polymer solution for use in an oil recovery operation, and the input well of an oilbearing formation.

In FIG. 6 of the drawing, the embodiment of the apparatus of FIG. 1 is shown positioned in a conduit positioned upstream with relation to an input well of a subterranean oil-bearing formation. As illustrated, an aqueous polymer solution contained in a diluter 70 is transported by means of a displacement pump 72 into the header 22, through the restriction 12, the nipple 18, the restriction 14, the nipple 20 and the restriction 16 into the conduit or header 24 which is in communication with the input well area of the formation. The location of the apparatus, of course, may be varied to accommodate the demands of the on-site operation.

The apparatus, and method, of the present invention provide a highly efficient, economical and practical means for preventing the degradation of polymer solutions. While the apparatus and method have been described and illustrated with relation to specific embodiments of the apparatus, and specific types of polymer solutions, it should be understood that such description and showing have been given by way of illustration and example, and not by way of limitation.

I claim:

1. Apparatus for controlling the flow of polymer solutions of the type employed as drive fluids and/or mobility control agents in the recovery of oil from subterranean oil-bearing formations to prevent shear degradation of the polymer dissolved in the solution, comprising: a polymer dilution station; conduit means positioned downstream with relation to the polymer dilution station for transporting a polymer solution from the polymer dilution station to an input well of a subterranean oil-bearing formation, said conduit means including at least two headers of the same diameter interconnected by a length of pipe which is shorter in length and smaller in diameter than the headers, the inlet end of one of the headers being in communication with said polymer dilution station; and flow control means in the form of a needle valve having its outlet in communication with the input well of a subterranean oil-bearing formation, said at least two headers and said shorter length of pipe cooperating with said flow control means to effect a substantial drop in fluid pressure as the polymer solution flows therethrough while at the same time preventing any substantial degradation of the polymer dissolved in the solution.

2. Apparatus according to claim wherein the conduit means includes a plurality of said small diameter pipes positioned in spaced relation to one another, and each of which interconnects two headers in series.

3. A method for controlling the flow of polymer solutions of the type employed as drive fluids and/or mobility control agents in the recovery of oil from subterranean oil-bearing formations to prevent shear degradation of the polymer dissolved in the solution prior to introducing the polymer solution into an input well of the oil-bearing formation: including the steps of diluting the polymer solution to provide a concentration of the polymer in the solution sufficient to enable the solution to substantially meet the permeability requirements of an oil-bearing subterranean formation; passing the diluted polymer solution at one fluid pressure through conduit means comprising at least two headers having the same diameter interconnected in spaced relation to one another by a length of pipe which is shorter in length and smaller in diameter than the headers, and flow control means in the form of a needle valve, said headers, said pipe, and said valve cooperating to effect a lowering of the fluid pressure of the polymer solution while at the same time substantially preventing any shear degradation of the polymer dissolved in the solution and transporting the polymer solution to an input well site where it is to be introduced into an oil-bearing formation.

4. A method according to claim 3 wherein the polymer solution is an aqueous solution of a partially hydrolyzed polyacrylamide.

5. A method according to claim 3 wherein the polymer solution is passed through more than two headers having the same diameter each of which is connected in series by a length of said small diameter pipe.

* * * * *